US010485285B2

(12) United States Patent
Dixon

(10) Patent No.: US 10,485,285 B2
(45) Date of Patent: Nov. 26, 2019

(54) BREAKAWAY FACEMASK SYSTEM

(71) Applicant: Jerome L. Dixon, Indianapolis, IN (US)

(72) Inventor: Jerome L. Dixon, Indianapolis, IN (US)

( * ) Notice: Subject to any disclaimer, the term of this patent is extended or adjusted under 35 U.S.C. 154(b) by 177 days.

(21) Appl. No.: 15/667,769

(22) Filed: Aug. 3, 2017

(65) Prior Publication Data

US 2019/0037956 A1 Feb. 7, 2019

(51) Int. Cl.
*A42B 3/20* (2006.01)
*A63B 71/10* (2006.01)

(52) U.S. Cl.
CPC ..... *A42B 3/20* (2013.01); *A63B 71/10* (2013.01)

(58) Field of Classification Search
CPC ..... A42B 3/20; A42B 3/205; A42B 3/221; A42B 3/326; A42B 3/328; A42B 3/04; A42B 3/18; Y10T 24/3444; Y10T 24/1321; Y10T 24/1356; Y10T 24/44026; A63B 71/10
USPC ..... 24/545, 458, 338, 339, 457
See application file for complete search history.

(56) References Cited

U.S. PATENT DOCUMENTS 3,139,624 A * 7/1964 Humphrey ..... A42B 3/20 2/9
3,154,281 A * 10/1964 Frank ..... F16B 21/06 174/138 G
3,213,500 A * 10/1965 Thompson ..... F16B 21/086 174/164
3,263,236 A * 8/1966 Humphrey ..... A42B 3/20 2/9
3,776,092 A * 12/1973 Seckerson ..... F16B 5/0685 24/339
3,889,296 A 6/1975 Martin
3,905,570 A * 9/1975 Nieuwveld ..... F16L 3/127 24/339
3,983,602 A * 10/1976 Barry ..... A42B 3/04 24/11 R
4,233,687 A 11/1980 Lancellotti
D257,950 S * 1/1981 Van Meter, Jr. ..... F16L 3/127 D13/154
4,363,140 A * 12/1982 Correale ..... A42B 3/20 2/424
4,442,571 A * 4/1984 Davis ..... F16B 5/10 24/586.1
4,885,807 A 12/1989 Snow, Jr.
4,947,490 A 8/1990 Hayden
4,985,938 A * 1/1991 Snow, Jr. ..... A42B 3/20 2/424
5,963,990 A 10/1999 White
(Continued)

FOREIGN PATENT DOCUMENTS

CA 1116801 A * 1/1982 ..... A42B 3/20

*Primary Examiner* — Amy Vanatta

(57) ABSTRACT

A breakaway facemask system for reducing injuries from a facemask penalty in American football includes a helmet that is worn during athletic activities. A cage is removably coupled to the helmet. The cage is positioned to cover to the opening thereby protecting a user's face from impact. A plurality of retainers is provided and each of the retainers is coupled to the helmet. Each of the retainers releasably engages the cage such that the cage is removably coupled to the helmet. The cage breaks away from the helmet when the cage is gripped thereby reducing the possibility of injury to the user.

9 Claims, 5 Drawing Sheets

(56) References Cited

U.S. PATENT DOCUMENTS

| | | | | |
|---|---|---|---|---|
| 6,047,400 | A * | 4/2000 | Spencer | A42B 3/20 2/424 |
| D587,852 | S | 3/2009 | Nimmons | |
| 8,146,178 | B2 | 4/2012 | Maddux et al. | |
| 2017/0245575 | A1* | 8/2017 | Branch | A42B 3/046 |

* cited by examiner

BREAKAWAY FACEMASK SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention.

(2) Description of Related Art Including Information Disclosed Under 37 CFR 1.97 and 1.98.

The disclosure and prior art relates to facemask devices and more particularly pertains to a new facemask device for reducing injuries from a facemask penalty in American football.

BRIEF SUMMARY OF THE INVENTION

An embodiment of the disclosure meets the needs presented above by generally comprising a helmet that is worn during athletic activities. A cage is removably coupled to the helmet. The cage is positioned to cover to the opening thereby protecting a user's face from impact. A plurality of retainers is provided and each of the retainers is coupled to the helmet. Each of the retainers releasably engages the cage such that the cage is removably coupled to the helmet. The cage breaks away from the helmet when the cage is gripped thereby reducing the possibility of injury to the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
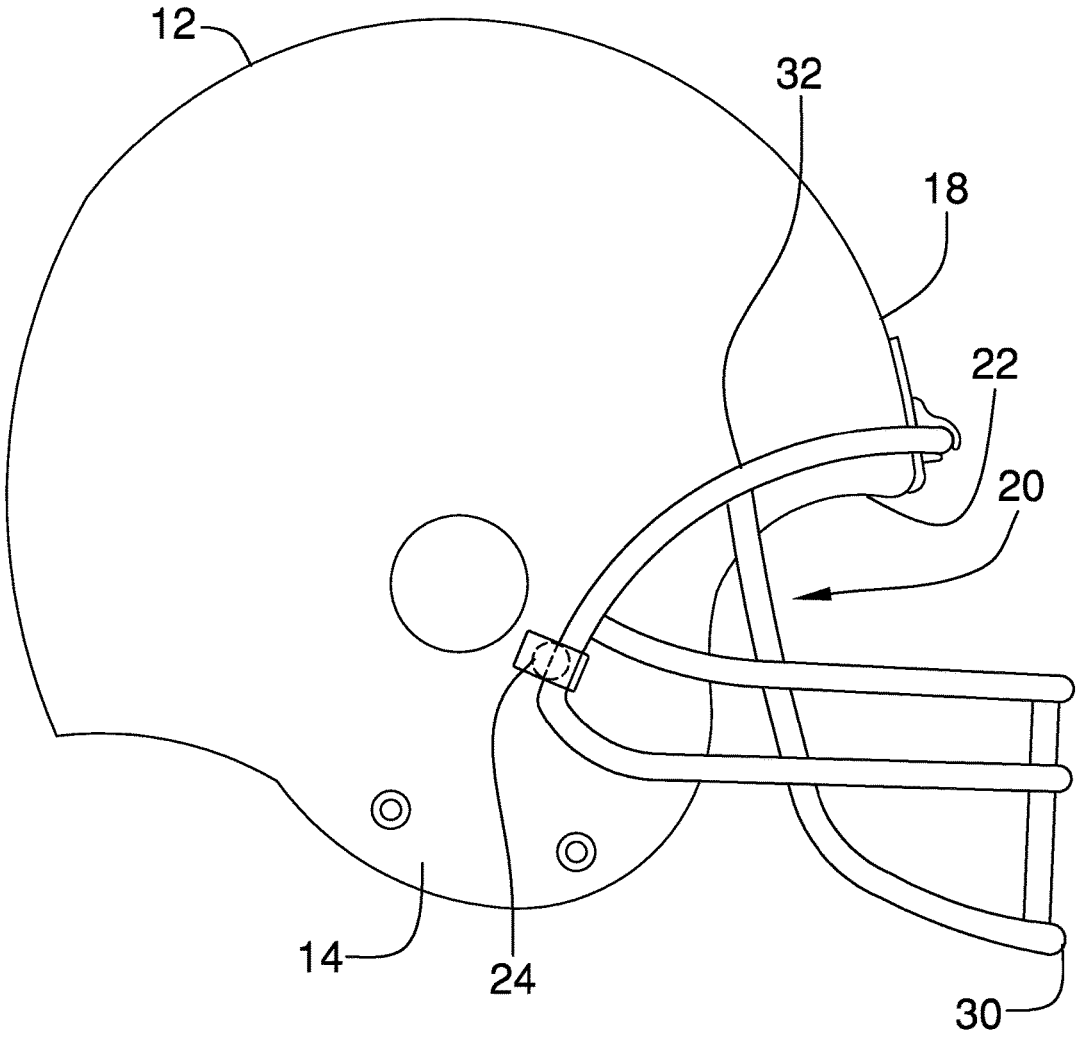
FIG. 1 is a right side view of a breakaway facemask system according to an embodiment of the disclosure.
Figure 2:
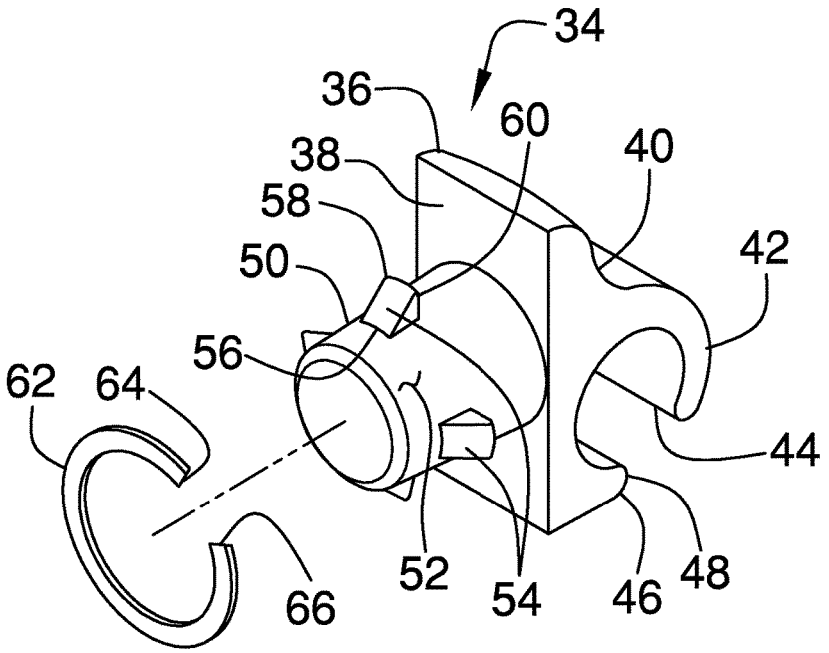
FIG. 2 is an exploded perspective view of a retainer of an embodiment of the disclosure.
Figure 3:
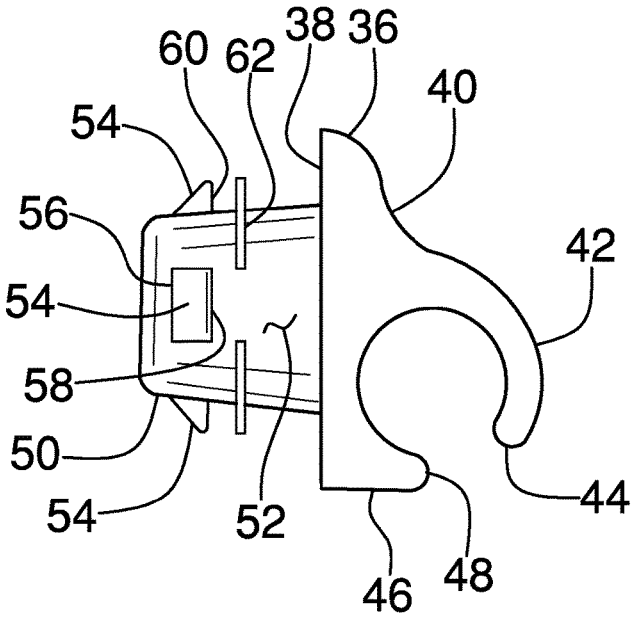
FIG. 3 is a right side view of a retainer of an embodiment of the disclosure.
Figure 4:
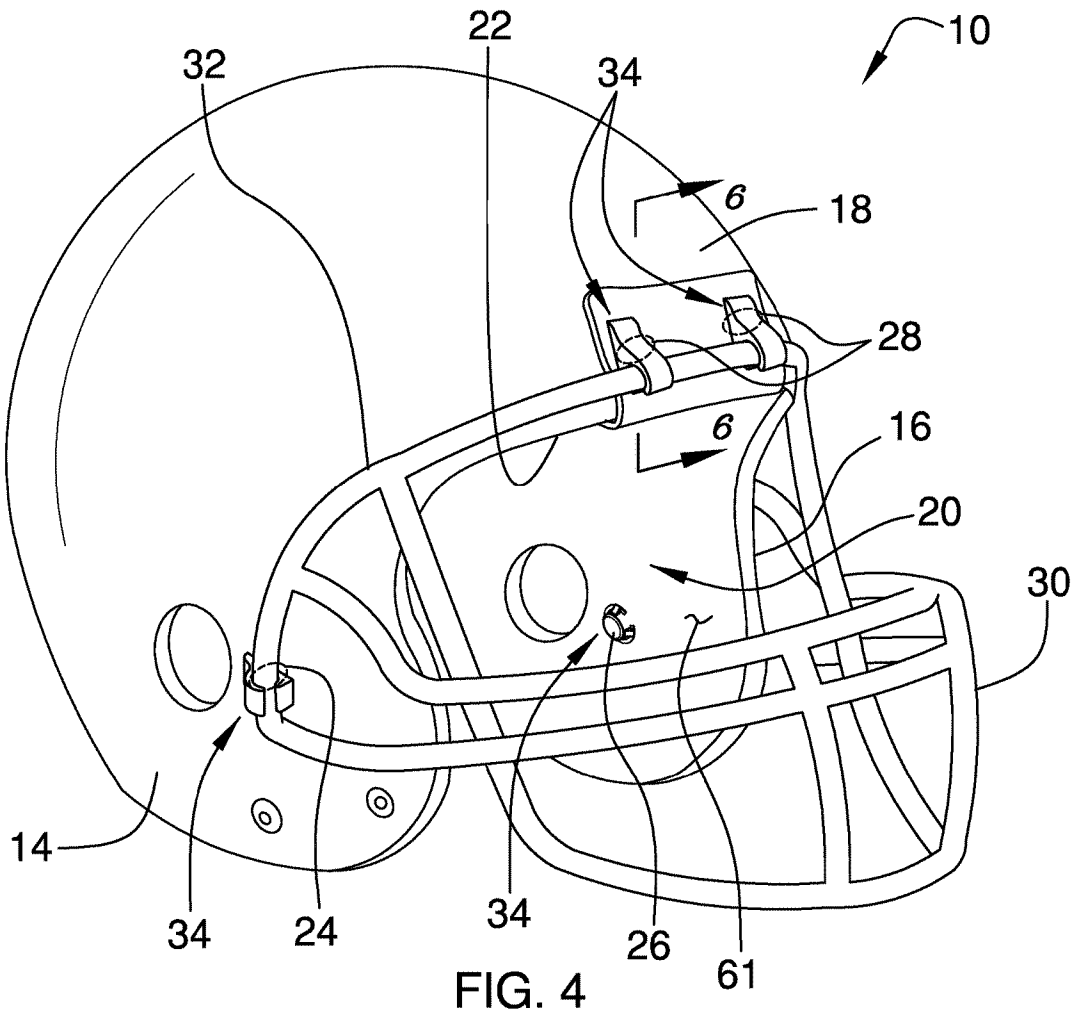
FIG. 4 is a perspective in-use view of an embodiment of the disclosure.
Figure 5:
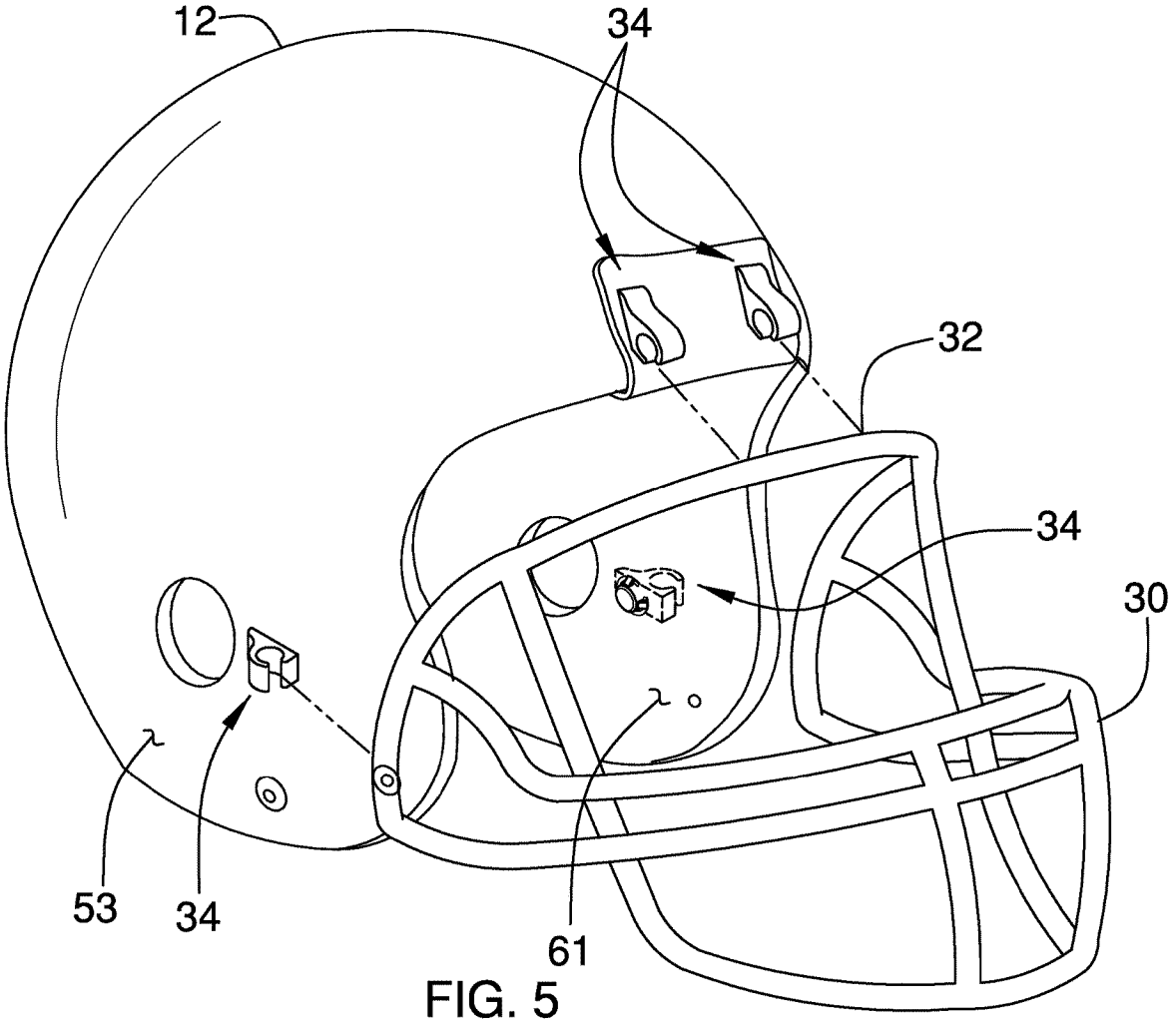
FIG. 5 is a perspective in-use view of an embodiment of the disclosure showing a cage being removed from a helmet.
Figure 6:
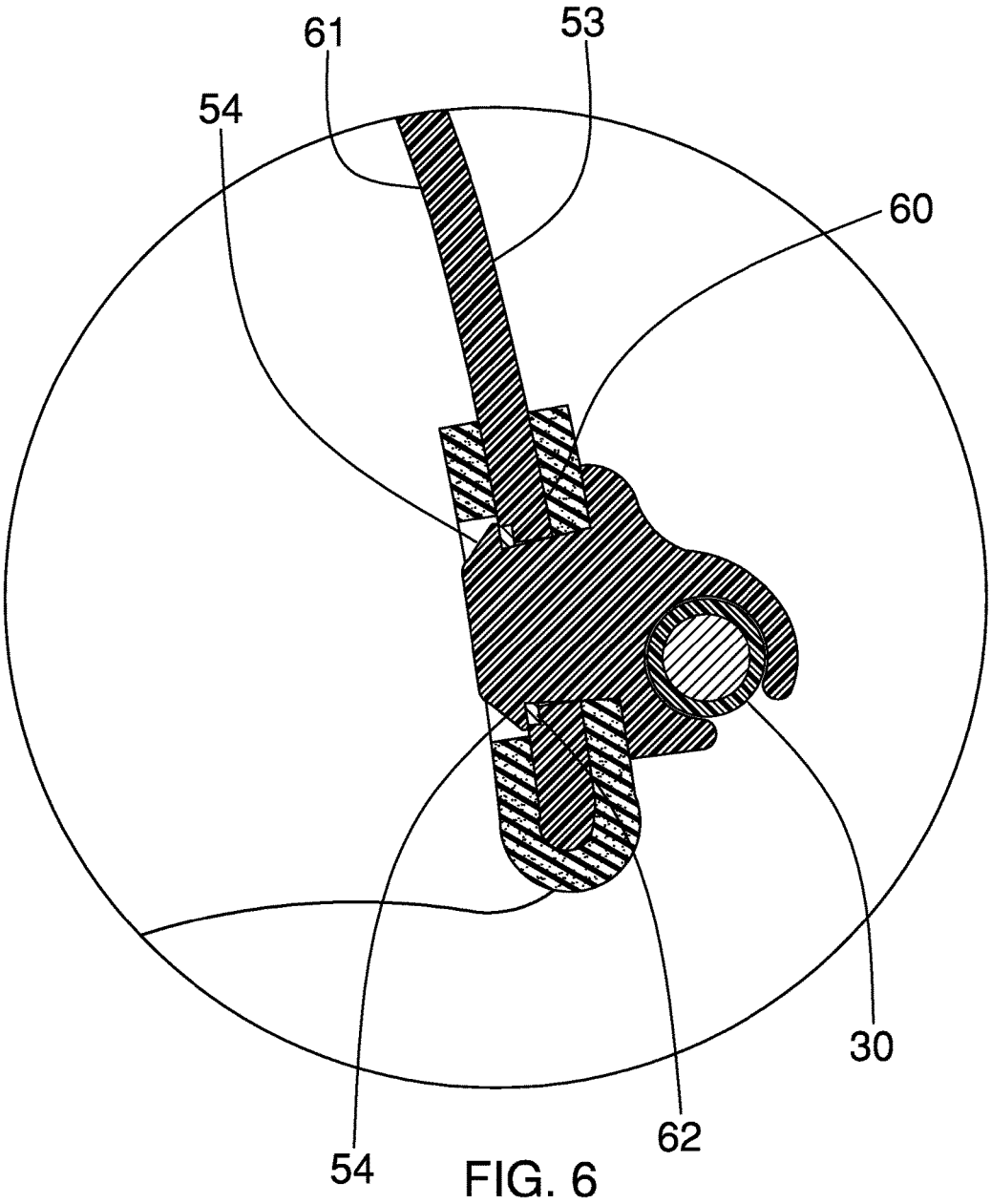
FIG. 6 is a cross sectional view taken along line 6-6 of FIG. 4 of an embodiment of the disclosure.

With reference now to the drawings, and in particular to FIGS. 1 through 6 thereof, a new facemask device embodying the principles and concepts of an embodiment of the disclosure and generally designated by the reference numeral 10 will be described.

As best illustrated in FIGS. 1 through 6, the breakaway facemask system 10 generally comprises a helmet 12 that may be worn during athletic activities. The helmet 12 has a first lateral side 14, a second lateral side 16 and a front side 18. The front side 18 has an opening 20 therein to expose a face of a user when the helmet 12 is worn and the opening 20 has a bounding edge 22. The first lateral side 14 has a first aperture 24 extending therethrough and the second lateral side 16 has a second aperture 26 extending therethrough. The front side 18 has a pair of third apertures 28 extending therethrough. Each of the third apertures 28 is spaced from the bounding edge 22 of the opening 20 and each of the third apertures 28 is centrally positioned on the front side 18. The helmet 12 may be an American football helmet and the helmet 12 may be worn while playing American football.

A cage 30 is provided and the cage 30 is removably coupled to the helmet 12. The cage 30 is positioned to cover to the opening 20 to protect the user's face from impact. The cage 30 has an outermost member 32 and the cage 30 may be an American football facemask of any conventional design.

A plurality of retainers 34 is provided and each of the retainers 34 is coupled to the helmet 12. Each of the retainers 34 releasably engages the cage 30 such that the cage 30 is removably coupled to the helmet 12. Thus, the cage 30 breaks away from the helmet 12 when the cage 30 is gripped by an opposing player during a facemask penalty. In this way the retainers 34 reduce the possibility of injury to the user as a result of the facemask penalty.

Each of the retainers 34 comprises a clip 36 that has a first side 38 and a second side 40. The second side 40 has a first protuberance 42 extending away from the second side 40. The first protuberance 42 has a first end 44. Moreover, the first protuberance 42 is concavely arcuate between the first end 44 and the second side 40. The first protuberance 42 is centrally positioned on the second side 40.

The second side 40 has a second protuberance 46 extending away from the second side 40 and the second protuberance 46 is spaced from the first protuberance 42. The second protuberance 46 has a distal end 48 with respect to the second side 40. The first end 44 of the first protuberance 42 is spaced from the distal end 48 of the second protuberance 46 such that the first 42 and second 46 protuberances form an open loop. The open loop has an inside diameter that is equal to an outside diameter of the outermost member 32. Additionally, the space between the first end 44 and the distal end 48 has a width that is less than the outer diameter of the outermost member 32.

The clip 36 is comprised of a resiliently deformable material. Thus, the outermost member 32 on the cage 30 is selectively urged between the first end 44 of the first protuberance 42 and the distal end 48 of the second protuberance 46. In this way the clip 36 frictionally engages the outermost member 32 to removably retain the cage 30 on the helmet 12. The first end 44 of the first protuberance 42 is urged away from the distal end 48 of the second protuberance 46 when the cage 30 is gripped during the facemask penalty. In this way the outermost member 32 of the cage 30 passes between the first 42 and second 46 protuberances when the cage 30 is gripped during the facemask penalty.

A stem 50 is provided that extends away from the first side 38 of the clip 36 and the stem 50 has an outer surface 52. The stem 50 is extended through a selected one of the first 24, second 26 and third apertures 28 in the helmet 12. The first side 38 of the clip 36 abuts an outside surface 53 of the helmet 12 when the stem 50 is extended through the selected first 24, second 26 and third 28 apertures. The stem 50 on each of the retainers 34 includes a plurality of ridges 54. Each of the ridges 54 extends outwardly from the outer surface 52 of the stem 50 and the ridges 54 are spaced apart from each other and are distributed around the stem 50.

Each of the ridges 54 has a first end 56 and a second end 58. Each of the ridges 54 slopes outwardly from the stem 50 between the first 56 and second 58 end to define a terminal surface 60 of the ridges 54. The terminal surface 60 of each of the ridges 54 is spaced from the first side 38 of the clip 36. Moreover, each of the ridges 54 is comprised of a resiliently compressible material. Thus, each of the ridges 54 is compressed when the stem 50 is extended through the selected first 24, second 26 and third 28 apertures. The terminal surface 60 of each of the ridges 54 abuts an inside surface 61 of the helmet 12 thereby inhibiting the stem 50 from being removed from the selected first 24, second 26 and third apertures 28.

A ring 62 is provided that has a primary end 64 and a secondary end 66. The primary end 64 is spaced from the secondary end 66 such that the ring 62 forms an open loop. The ring 62 is positioned around the stem 50 when the stem 50 is extended through the selected first 24, second 26 and third apertures 28. Moreover, the ring 62 is positioned between the terminal surface 60 of the ridges 54 and the inside surface 61 of the helmet 12 to retain the clip 36 on the helmet 12.

In use, the stem 50 corresponding to each of the retainers 34 is extended through the selected first 24, second 26 and third 28 apertures. The ridges 54 on the corresponding retainer 34 are compressed as the ridges 54 pass through the selected first 24, second 26 and third apertures 28 until the ridges 54 on the corresponding retainer fully pass through the selected first 24, second 26 and third 28 apertures. The ring 62 is positioned around the stem 50 of the corresponding retainer when the stem 50 is fully extended through the selected first 24, second 26 and third 28 apertures. In this way each of the retainers 34 is removably coupled to the helmet 12. The outermost member 32 of the cage 30 is manipulated to engage the clip 36 on each of the retainers 34. The cage 30 is selectively urged outwardly from the clip 36 on each of the retainers 34 when the cage 30 is gripped during a facemask penalty. In this way the user is protected from injuries that can result from the facemask penalty.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A breakaway facemask system comprising:

a helmet being configured to be worn during athletic activities, said helmet having a first lateral side, a second lateral side and a front side, said front side having an opening therein to expose a face when said helmet is worn;

a cage being removably coupled to said helmet, said cage being positioned to cover said opening wherein said cage is configured to protect a face of a user from impact; and a plurality of retainers, each of said retainers being coupled to said helmet, each of said retainers releasably engaging said cage such that said cage is removably coupled to said helmet wherein said cage is configured to break away from said helmet when said cage is gripped thereby reducing the possibility of injury to the user, each of said retainers comprising a clip having a first side and a second side, said second side having a first protuberance extending away from said second side, said first protuberance having a first end, said first protuberance being concavely arcuate between said first end and said second side, said first protuberance being centrally positioned on said second side, said second side has a second protuberance extending away from said second side, said second protuberance being spaced from said first protuberance, said second protuberance having a distal end with respect to said second side, said distal end of said second protuberance being spaced from said first end of said first protuberance such that said first and second protuberances form an open loop, a length of said first protuberance being longer than a length of said second protuberance wherein a gap between said distal end of said second protuberance and said first end of said first protuberance faces away from said second side at an acute angle relative to said second side.

2. The system according to claim 1, further comprising said opening having a bounding edge, said first lateral side having a first aperture extending therethrough, said second lateral side having a second aperture extending therethrough, said front side having a pair of third apertures extending therethrough, each of said third apertures being spaced from said bounding edge of said opening, each of said third apertures being centrally positioned on said front side.

3. The system according to claim 1, further comprising a stem extending away from said first side of said clip, said stem having an outer surface, said stem being extended through a selected one of a first, second and third apertures in said helmet having said first side of said clip abutting an outside surface of said helmet.

4. The system according to claim 1, wherein:

said cage has an outermost member; and said outermost member on said cage is urged between said first end of said first protuberance and said distal end of said second protuberance such that said clip frictionally engages said outermost member, said clip being comprised of a resiliently deformable material such that said outermost member is selectively urged outwardly from said clip when said cage is gripped.

5. The system according to claim 3, further comprising a plurality of ridges, each of said ridges extending outwardly from said outer surface of said stem, said ridges being spaced apart from each other and being distributed around said stem.

6. The system according to claim 5, wherein each of said ridges has a first end and a second end, each of said ridges sloping outwardly from said stem between said first and second end to define a terminal surface of said ridges, said terminal surface of each of said ridges being spaced from said first side of said clip.

7. The system according to claim 6, wherein:

said helmet has a first aperture, a second aperture and a pair of third apertures; and each of said ridges is comprised of a resiliently compressible material such that each of said ridges is compressed when said stem is extended through said selected first, second or third aperture, said terminal surface of each of said ridges abutting an inside surface of said helmet thereby inhibiting said stem from being removed from said selected first, second and third aperture.

8. The system according to claim 7, further comprising a ring having a primary end and a secondary end, said primary end being spaced from said secondary end such that said ring forms an open loop, said ring being positioned around said stem when said stem is extended through said selected first, second and third apertures, said ring being positioned between said terminal surface of said ridges and said inside surface of said helmet to retain said clip on said helmet.

9. A breakaway facemask system comprising:

a helmet being configured to be worn during athletic activities, said helmet having a first lateral side, a second lateral side and a front side, said front side having an opening therein to expose a face when said helmet is worn, said opening having a bounding edge, said first lateral side having a first aperture extending therethrough, said second lateral side having a second aperture extending therethrough, said front side having a pair of third apertures extending therethrough, each of said third apertures being spaced from said bounding edge of said opening, each of said third apertures being centrally positioned on said front side;

a cage being removably coupled to said helmet, said cage being positioned to cover said opening wherein said cage is configured to protect the face from impact, said cage having an outermost member; and a plurality of retainers, each of said retainers being coupled to said helmet, each of said retainers releasably engaging said cage such that said cage is removably coupled to said helmet wherein said cage is configured to break away from said helmet when said cage is gripped thereby reducing the possibility of injury to a user of the helmet, each of said retainers comprising:

a clip having a first side and a second side, said second side having a first protuberance extending away from said second side, said first protuberance having a first end, said first protuberance being concavely arcuate between said first end and said second side, said first protuberance being centrally positioned on said second side, said second side having a second protuberance extending away from said second side, said second protuberance being spaced from said first protuberance, said second protuberance having a distal end with respect to said second side, said distal end of said second protuberance being spaced from said first end of said first protuberance such that said first and second protuberances form an open loop, a length of said first protuberance being longer than a length of said second protuberance wherein a gap between said distal end of said second protuberance and said first end of said first protuberance faces away from said second side at an acute angle relative to said second side, said outermost member on said cage being urged between said first end of said first protuberance and said distal end of said second protuberance such that said clip frictionally engages said outermost member, said clip being comprised of a resiliently deformable material such that said outermost member is selectively urged outwardly from said clip when said cage is gripped, a stem extending away from said first side of said clip, said stem having an outer surface, said stem being extended through a selected one of said first, second and third apertures in said helmet having said first side of said clip abutting an outside surface of said helmet, a plurality of ridges, each of said ridges extending outwardly from said outer surface of said stem, said ridges being spaced apart from each other and being distributed around said stem, each of said ridges having a first end and a second end, each of said ridges sloping outwardly from said stem between said first and second end to define a terminal surface of said ridges, said terminal surface of each of said ridges being spaced from said first side of said clip, each of said ridges being comprised of a resiliently compressible material such that each of said ridges is compressed when said stem is extended through said selected first, second or third aperture, said terminal surface of each of said ridges abutting an inside surface of said helmet thereby inhibiting said stem from being removed from said selected first, second and third aperture, and a ring having a primary end and a secondary end, said primary end being spaced from said secondary end such that said ring forms an open loop, said ring being positioned around said stem when said stem is extended through said selected first, second and third apertures, said ring being positioned between said terminal surface of said ridges and said inside surface of said helmet to retain said clip on said helmet.

* * * * *